US005279512A

United States Patent [19]

Manale

[11] Patent Number: 5,279,512

[45] Date of Patent: Jan. 18, 1994

[54] TOY WATERWHEEL

[76] Inventor: Joseph P. Manale, P.O. Box 3055, Covington, La. 70434

[21] Appl. No.: 933,760

[22] Filed: Aug. 24, 1992

[51] Int. Cl.[5] ..... A63H 33/40; A63H 3/52

[52] U.S. Cl. ..... 446/217; 446/267

[58] Field of Search ..... 446/166, 167, 217, 267; 434/126

[56] References Cited

U.S. PATENT DOCUMENTS

| | | | |
|---|---|---|---|
| 871,399 | 11/1907 | Green | 446/217 |
| 923,640 | 8/1908 | Gaube et al. . | |
| 1,570,996 | 2/1925 | Dennison . | |
| 1,594,720 | 8/1926 | Gee . | |
| 2,272,582 | 3/1937 | Poppe . | |
| 3,116,695 | 1/1964 | Faller | 446/166 |
| 3,425,152 | 3/1967 | Foulkes . | |
| 3,477,723 | 12/1967 | Djedda . | |
| 3,987,307 | 10/1976 | Giconi | 290/1 D |
| 5,049,080 | 9/1991 | Kriebel | 434/300 |

FOREIGN PATENT DOCUMENTS

| | | | |
|---|---|---|---|
| 374124 | 6/1932 | United Kingdom | 446/267 |

*Primary Examiner*—Robert A. Hafer
*Assistant Examiner*—Gregory M. Stone
*Attorney, Agent, or Firm*—David L. Ray

[57] ABSTRACT

A toy waterwheel including a transparent water-tight container, a rotatable wheel connected to the interior of the container, an electric pump for pumping water to and from the container, a nozzle connected to the container for directing water to the wheel to turn the wheel, a first hose connected to the electric pump and the nozzle for conveying water to the nozzle, and a second hose connected to the container and to the pump for conveying water from the container to the pump.

2 Claims, 3 Drawing Sheets

TOY WATERWHEEL

BACKGROUND OF THE INVENTION

1. Field of the Invention

The invention relates to an amusement device. More particularly, the present invention relates to an amusement device in the form of a wheel turned by a stream of water.

2. Description of the Related Art

Wheels turned by material striking the wheel such as water are known in the art. The following U.S. Patents disclose related devices:

U.S. Pat. No. 5,049,080 discloses a waterwheel demonstrating apparatus for demonstrating and illustrating to students that random appearing phenomena occurring in natural systems such as biological, chemical, physical, and mathematical may actually reflect the action of simple underlying non-random processes or deterministic systems that illustrate basic concepts of dynamics and chaos theory. A dual wheel device is provided in which one wheel is driven by a stream of water and the other wheel acts as a brake, resisting the rotation created by the first wheel by dragging a series of vanes through a water bath. The operation of the device can be varied and controlled by varying one or the other of the parameters, including the water level in the braking compartment to cause different states of operation, namely periodic or chaotic.

U.S. Pat. No. 3,987,307 discloses a particulate material powered prime motive device powered by the tailings of mines, the crushed material emanating from quarries and/or the earth removed in strip mining operations. The system takes advantage of the fact that in any mine-like operation a relatively large hole is produced which extends for a finite distance below the normal topography of the surface of the surrounding land. The system includes a driven wheel mounted in a horizontal axis having a particulate matter receiving device at the outermost circumference thereof. The wheel is located near substantially the bottom of the quarry or pit. A guidance device is provided to discharge the aforementioned particulate material from the upper reaches of the quarry or pit onto the flights or buckets of the driven wheel. The wheel, as in the case of a water wheel, discharges the particulate material onto a slide. The particulate material then slides to an area of accumulation adapted and constructed to make the particulate material accessible to a vertically oriented endless conveyer system having buckets designed to carry the particulate material upwardly to a hopper from which the particulate material is then redistributed to the driven wheel. The endless conveyer is driven by a suitable device such as an electric motor or internal combustion engine. The driven wheel may be suitably coupled through a transmission to an electric generator. The current produced by the generator may be used to supplement the requirements of the motive device employed to drive the endless conveyer system.

U.S. Pat. No. 3,477,723 discloses a water pistol affixed by a water-tight connection to a transparent housing containing targets. The nozzle of the water pistol is fixed in a piston, or is aimable, so that the discharge from the nozzle impinges on the targets and moves them. A water return tube connects the housing with a reservoir of the water pistol thereby providing an enclosed path for circulation of the water.

U.S. Pat. No. 3,425,152 discloses a fluid stream generator which is an apparatus for generating a fluid stream including a container, a plurality of compartments within the container, a device for establishing fluid pressure between a first and a third of the compartments, a device for transferring pressure from the third compartment to a second compartment, and a device for permitting fluid to pass from the second compartment into the first compartment, whereby pressure established in the third compartment is transferred to the second compartment to permit a fluid contained therein to be driven into the first compartment as a fluid stream.

U.S. Pat. No. 2,272,582 discloses a pond and fish bowl adapted to be positioned in the pond, the fish-bowl having flanges on three sides thereof, which flanges are adapted to engage with the edges of the pond, upright short slots in the fish-bowl through which water is adapted to flow from the fish-bowl into the pond, the bottoms of the slots being above the bottom of the bowl a sufficient distance to retain in the bowl water enough for the fish to swim in, a long slot in the bowl, a stud placed over the side of the fish-bowl in line with the long slot, the stud having a water wheel rotatably and removably mounted thereon, the stud being engaged in the slot on the raising of the bowl and permitting the raising of the bowl.

U.S. Pat. No. 1,594,720 discloses a toy water mill of the character set forth including a miniature house, a floor partition within the upper portion of the house setting up a water chamber, an enclosure having a rear wall extending from the back wall of the house and a side wall extending from the rear wall transversely of the house and extended a substantial distance beyond the front thereof, a removable shaft extending transversely of the enclosure and having one end mounted in the house and the other end mounted in the side wall, a paddle wheel carried by the shaft, a water pipe leading from the interior of the chamber to and terminating over the wheel, and a removable receptacle positioned to receive water discharged over the wheel and held in position therebeneath by the side and rear walls of the enclosure and the end wall of the house.

U.S. Pat. No. 1,570,996 discloses a mechanical toy which is in an enclosing case including an independently constructed upper section (A) having a top, bottom, sides and ends, the sides and ends at their junction with the bottom crimped to closely engage an an independently constructed lower section (B) having a bottom, top, sides and ends, the sides and ends at their junction with the top crimped to engage the intermediate section, an independently constructed intermediate section (C) having sides and ends only to engage with and be rigidly secured by a water tight connection at its top and bottom edges respectively to the crimped portions of the upper and lower sections (A and B) to form a single watertight case or casing to receive and support movable devices of various types, and actuators to actuate the devices.

U.S. Pat. No. 923,640 discloses a toy water-mill including, in combination, a casing, a water wheel supported exteriorly thereof, a lower tank provided in the casing, an upper tank in the casing, a pumping mechanism between the lower tank and the upper tank for forcing water from the former into the latter, a third tank arranged below the water wheel, a device for returning water from the third tank into the lower tank, and a trough leading from the upper tank and arranged to discharge water against the water wheel.

SUMMARY OF THE INVENTION

In accordance with the present invention there is provided a toy waterwheel including a transparent water-tight container, a rotatable wheel connected to the interior of the container, an electric pump for pumping water to and from the container, a nozzle connected to the container for directing water to the wheel to turn the wheel, a first hose connected to the electric pump and the nozzle for conveying water to the nozzle, and a second hose connected to the container and to the pump for conveying water from the container to the pump.

DESCRIPTION OF THE PREFERRED EMBODIMENTS

Figure 1:
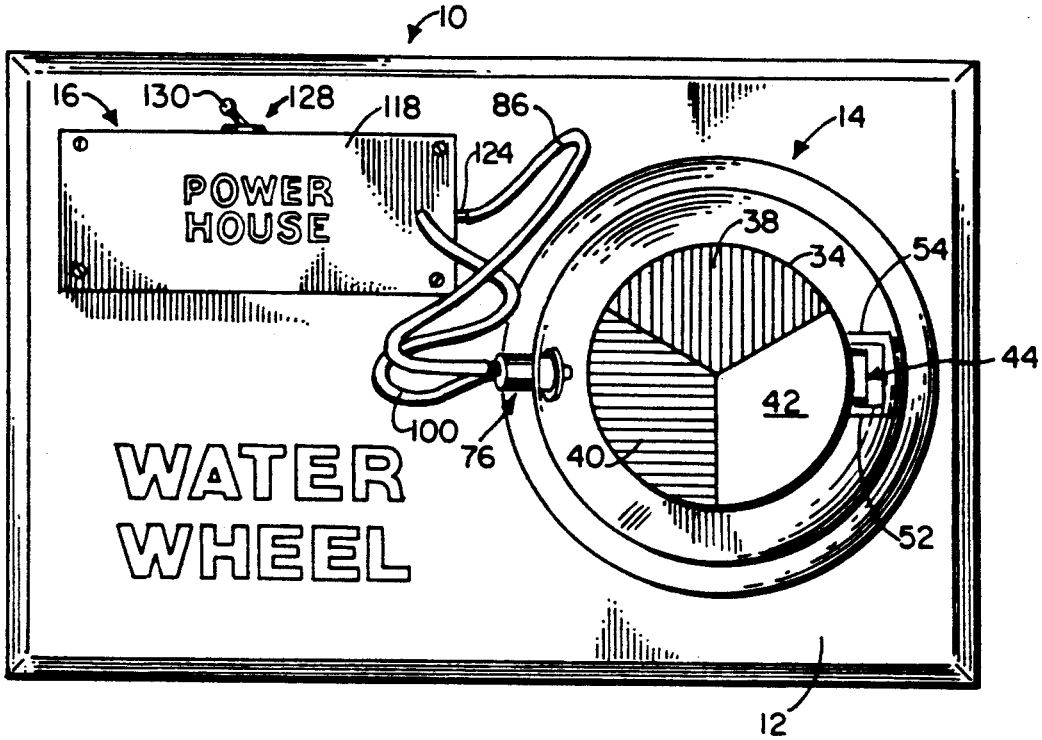
FIG. 1 is a top view of the toy of the invention.
Figure 2:
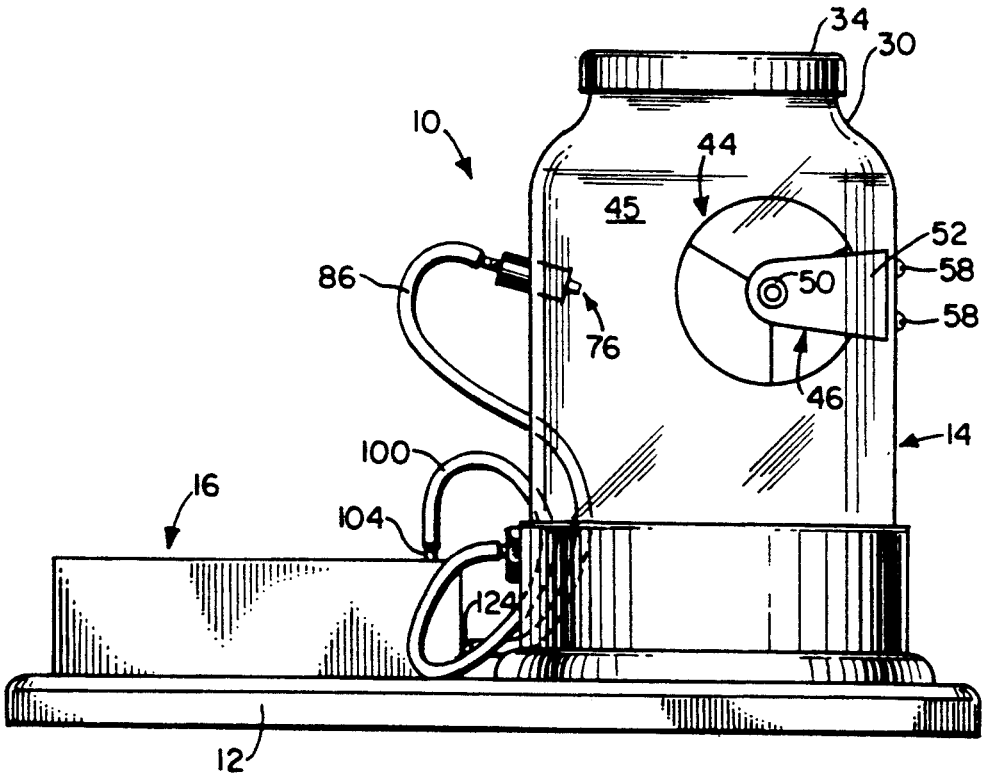
FIG. 2 is a side elevational view of the toy of the invention.

Referring now to the drawings, in FIGS. 1 and 2 are shown the toy of the invention generally indicated by the numeral 10. Toy 10 has a generally flat, rectangular base plate 12 which may be made from wood, metal, polymeric plastic materials such as polyvinyl chloride or the like, or any other suitable material.

Connected to base plate 12 is a water-tight container generally indicated by the numeral 14 and a pump housing generally indicated by the numeral 16. Container 14 is a plastic jar or bottle constructed from a transparent polymeric material. Container 14 must be transparent to enable a person to view the interior of container 14.

Container 14 is received and snugly held in a hollow cylindrical base generally indicated by the numeral 18. Cylindrical base 18 has cylindrical side walls 20 extending vertically upward from base plate 12. At the bottom of cylindrical base 18 is integrally formed lip 22 which is shown fastened to base plate 12 by screws 24—24.

Figure 3:
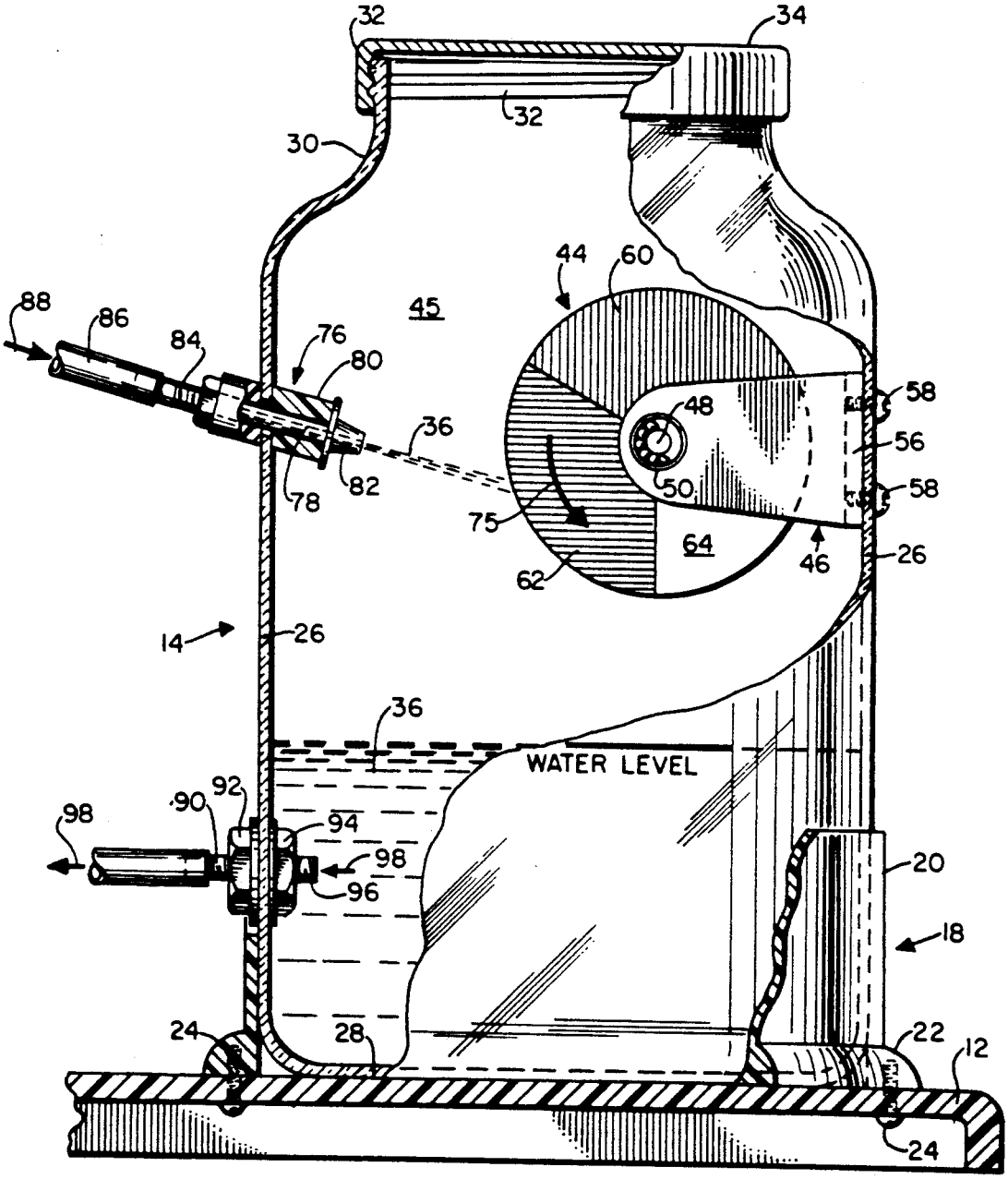
FIG. 3 is an enlarged, partly cut-away, partly cross-sectional view of the container, waterwheel and nozzle of the invention.

Container 14 has generally cylindrical side walls 26 which extend upward from a flat, circular bottom 28. Side walls 26 narrow at their top end to form neck 30. Neck 30 has threads 32 thereon for receipt of lid 34. When lid 34 is threaded or screwed onto threads 32 on neck 30 as shown in FIG. 3, none of the water 36 in container 14 can escape, and container 14 is water-tight. Preferably lid 34 is colored by painting or the like in three pie shaped patterns 38, 40, and 42 as shown in FIG. 1. Pattern 38 is red, pattern 40 is blue, and pattern 42 is white.

Connected to the inside or interior of side wall 26 of container 14 is the water driven wheel or waterwheel generally indicated by the numeral 44. Waterwheel 44 is rotatably connected in the interior 45 to sidewall 26 of container 14 by a bracket generally indicated by the numeral 46. Preferably waterwheel 44 is colored by painting or the like in three pie shaped patterns 60, 62, and 64 as shown in FIG. 3. Pattern 60 is red, pattern 62 is blue, and pattern 64 is white.

Bracket 46 rotatably receives axle 48 of waterwheel 44 in ball bearing 50 connected to bracket 46. Bracket 46 has two identical, parallel arms 52 and 54 as shown in FIGS. 1, 2, and 3 which extend toward the center of container 14 from an integrally formed base 56. Bracket 46 is connected to sidewall 26 of container 14 by screws 58—58 shown in FIGS. 2 and 3.

Figure 4:
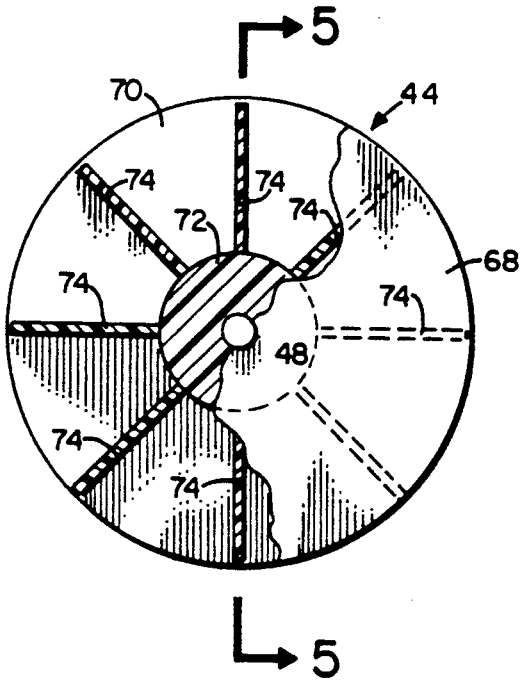
FIG. 4 is a partly cut-away, partly cross-sectional view of the waterwheel of the invention.
Figure 5:
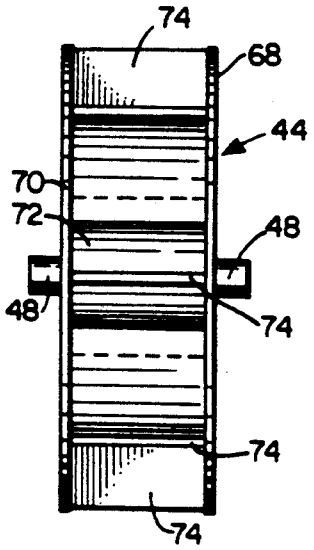
FIG. 5 is plan view of the waterwheel taken along lines 5—5 of FIG. 4.

Water wheel 44 is shown in greater detail in FIGS. 4 and 5. Water wheel 44 has two parallel circular sidewalls 68 and 70. Axle 48 is rigidly connected to a central cylinder 72. Extending radially outward from central cylinder 72 are preferably eight paddles 74—74 which connect sidewalls 68 and 70 together and are preferably integrally formed therewith. Paddles 74—74 are rectangular in shape and cause waterwheel 44 to rotate in the direction indicated by arrow 75 in FIG. 3 when water 36 exiting from the nozzle generally indicated by the numeral 76 strikes paddles 74—74 as shown in FIG. 3.

Nozzle 76 is connected to sidewall 26 of container 14 on the opposite side of container 14 from waterwheel 44. Nozzle 76 is aligned relative to waterwheel 44 as shown in FIG. 3 to direct water exiting or spraying from nozzle 76 onto the portion of waterwheel 44 beneath axle 48 to cause waterwheel 44 to turn in the direction indicated by the arrow 75 in FIG. 3.

As can best be seen in FIG. 3, nozzle 76 extends through sidewall 26 of container 14. Nozzle 76 may be connected to sidewall 26 of container 14 by gluing, or the like. Nozzle 76 has a hollow cylindrical channel 78 therein surrounded by a cylindrical body 80 and terminating in a tapered tip 82 from which water 36 is sprayed onto waterwheel 44. Nozzle 76 has a cylindrical tube 84 connected to the opposite end of nozzle 76 from tip 82. Flexible hose 86 conveys water in the direction indicated by the arrow 88 in FIG. 3 to nozzle 76.

As can best be seen in FIG. 3, tube 90 extends through sidewall 26 of container 14 at the lower end of container 14 beneath the water level of water 36. Tube 90 may be connected to sidewall 26 of container 14 by nuts 92 and 94 which are received on threads 96 located on the outside of tube 90. Tube 90 is hollow and conveys water 36 from the bottom of container 14 in the direction indicated by the arrows 98—98. Flexible hose 100 is connected to tube 90 and conveys water in the direction indicated by the arrow 98 in FIG. 3.

Figure 6:
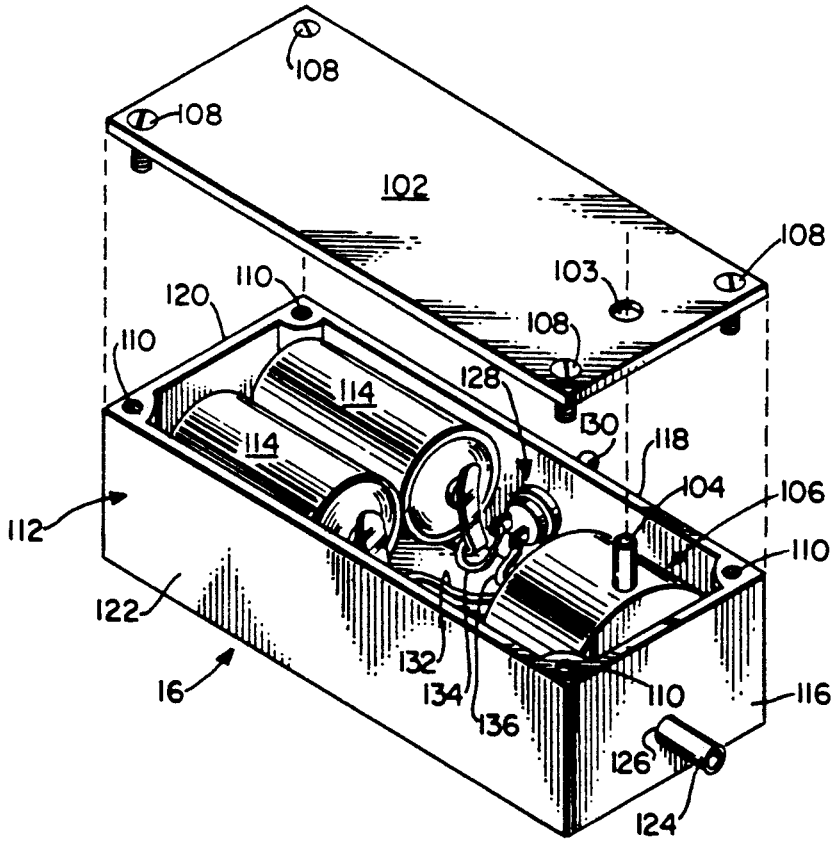
FIG. 6 is a perspective view of the pump housing, pump and batteries to power the pump utilized in the present invention.

As shown in FIG. 6, pump housing 16 has a rectangular shaped top plate 102. Rectangular top plate 102 has a circular opening 103 therein for receipt of pump inlet or suction 104 of conventional direct current electric pump 106. Rectangular top plate 102 has four screws 108—108 in the four corners thereof which are received in the pump housing box generally indicated by the numeral 112. Electric pump 106 and electrical storage batteries 114—114 are contained inside of pump housing box 112. Pump housing box 112 has four connected sidewalls 116, 118, 120 and 122. Pump discharge outlet 124 extends through a circular opening 126 in sidewall 116. A common electrical switch generally indicated by the numeral 128 having toggle 130 is connected to sidewall 118 to switch pump 106 on or off as desired. Switch 128 selectively electrically connects batteries 114—114 to pump 106 through electrically conductive wires 132, 134, and 136 to energize and activate pump 106.

Hose 86 is connected to pump discharge outlet 124 and hose 100 is connected to pump inlet or suction 104.

Thus, water is pumped is conveyed from the bottom of container 14 by hose 100 to pump suction inlet 104, and pumped from pump discharge outlet 124 by hose 86 to nozzle 76. Water is sprayed from nozzle 76 onto waterwheel 44 causing waterwheel 44 to rotate to the delight and amusement of observers. Water is placed in container 14 by removing lid 34, pouring water into the top of container 14, and securely screwing lid 34 onto container 14 to make container 14 water-tight.

Although the preferred embodiments of the invention have been described in detail above, it should be understood that the invention is in no sense limited thereby, and its scope is to be determined by that of the following claims:

What is claimed is:

1. A toy pump and waterwheel assembly comprising, in combination:

a. a base plate, said base plate being generally flat and rectangular in shape, said base plate having a top side and a bottom side;

b. a single transparent, hollow, generally cylindrical, jar-shaped water-tight container having cylindrical walls for containing water, said container being made from a polymeric material and having:

i. an upper end and a lower end, said upper end having a lid thereon, ii. a rotatable waterwheel rotatably connected to the interior of said cylindrical walls of said container above the level of water contained in said water-tight container by a bracket, said bracket being rigidly connected to the interior of said water-tight container, said waterwheel having:

a. two circular, parallel sidewalls having the same size, each of said sidewalls having an inside wall and an outside wall, each of said outside walls having colored patterns thereon for amusement of an observer as said waterwheel is turning, b. a plurality of rectangular paddles connecting said inside walls of said two parallel sidewalls of said waterwheel for causing said rotatable waterwheel to rotate when water is sprayed onto said paddles, said paddles extending radially outward from the center of said two parallel sidewalls, c. an axle connected to said bracket and to said waterwheel about which said waterwheel rotates, iii. a nozzle rigidly connected to said cylindrical wall of said container above the water level in said container, said nozzle extending through said cylindrical walls of said container and positioned to spray water onto said waterwheel beneath said axle to turn said waterwheel, iiii. a hollow tube rigidly connected to said cylindrical walls of said lower end of said container, said hollow tube being located beneath the water level of water contained in said container, said hollow tube extending through said cylindrical walls of said container to remove water from said container, c. a hollow cylindrical base means for receiving and holding said container, said hollow cylindrical base means being rigidly connected to said top side of said base plate, said hollow cylindrical base means having cylindrical sidewalls extending vertically upward from said base plate for snugly holding said lower end of said container, d. a direct current, battery operated electric pump for pumping water to and from said container, said electric pump having a discharge outlet and a suction inlet, e. a first hose connected to said discharge outlet of said electric pump and said nozzle for conveying water to said nozzle from said pump, and f. a second hose connected to said hollow tube in said lower end of said container and to said suction inlet of said pump for conveying water from said container to said pump, and g. a pump housing for containing said pump and batteries for supplying energy to operate said pump, said pump housing being connected to said top side of said base plate at a distance remote from said water-tight container, said pump housing having a switch thereon for selectively energizing said pump, said combination providing an enclosed water-tight path for the circulation of water through said pump and said water-tight container, whereby water propelled through said nozzle is sprayed onto said rotatable waterwheel to cause said rotatable waterwheel to rotate and amuse an observer.

2. The toy of claim 1 wherein said lid is threaded onto said container.

* * * * *